US010080976B2

(12) United States Patent
Ainley et al.

(10) Patent No.: US 10,080,976 B2
(45) Date of Patent: Sep. 25, 2018

(54) TOY COMPRISING A ROTOR, AN ACTIVATION MECHANISM AND A LAUNCHING DEVICE

(71) Applicant: LEGO A/S, Billund (DK)

(72) Inventors: Timothy Mark Ainley, Kolding (DK); Jesper Carol Nielsen, Bryrup (DK)

(73) Assignee: LEGO A/S (DK)

( * ) Notice: Subject to any disclaimer, the term of this patent is extended or adjusted under 35 U.S.C. 154(b) by 0 days.

(21) Appl. No.: 15/544,124

(22) PCT Filed: Jan. 18, 2016

(86) PCT No.: PCT/DK2016/050013

§ 371 (c)(1),
(2) Date: Jul. 17, 2017

(87) PCT Pub. No.: WO2016/116108

PCT Pub. Date: Jul. 28, 2016

(65) Prior Publication Data

US 2017/0361238 A1 Dec. 21, 2017

(30) Foreign Application Priority Data

Jan. 21, 2015 (DK) ..... 2015 70031

(51) Int. Cl.
*A63H 27/14* (2006.01)
*A63H 27/00* (2006.01)
*A63H 33/08* (2006.01)

(52) U.S. Cl.
CPC ..... *A63H 27/00* (2013.01); *A63H 27/14* (2013.01); *A63H 33/08* (2013.01)

(58) Field of Classification Search
CPC ..... A63H 17/008; A63H 27/12; A63H 27/14; A63H 33/08

(Continued)

(56) References Cited

U.S. PATENT DOCUMENTS 951,686 A * 3/1910 Katterjohn ..... A63H 27/14 446/39
2,051,151 A * 8/1936 Northrop ..... A63H 27/12 446/40

(Continued)

FOREIGN PATENT DOCUMENTS

CN 102743882 A 10/2012
EP 0 590 432 A2 4/1994

(Continued)

OTHER PUBLICATIONS

USPTO's Non-Final Office Action together with list of references, issued in related U.S. Appl. No. 15/544,094, dated Nov. 17, 2017.

(Continued)

*Primary Examiner* — Alexander Niconovich
(74) *Attorney, Agent, or Firm* — Day Pitney LLP

(57) ABSTRACT

A toy comprising a rotor, an actuator means, and a launch device, wherein the rotor comprises an actuator mechanism, and wherein a toy building element comprises a launch device in the form of a cavity configured for receiving the actuator mechanism, and wherein the actuator means can be inserted into a through-going slit opening to cooperate with the actuator mechanism to transfer momentum from the actuator means to the rotor, whereby the rotor can be rotated and launched from the launch device. The toy comprises at least two toy building elements, a first toy building element comprising the launch device and one or more of a first type of coupling means, and a second toy building element provided with one or more of a second types of coupling means that are geometrically configured to relative to the first type of coupling means, whereby the first and second types of coupling means can be releasably interconnected to form a spatial structure comprising the launch device.

13 Claims, 4 Drawing Sheets

(58) Field of Classification Search
USPC ..... 446/34, 36, 38, 40, 41, 42, 45, 435, 429
See application file for complete search history.

(56) References Cited

U.S. PATENT DOCUMENTS

| | | | | | |
|---|---|---|---|---|---|
| 2,561,554 | A * | 7/1951 | Barist | A63H 5/04 | 446/42 |
| 2,938,300 | A * | 5/1960 | Newbert | A63H 27/12 | 446/41 |
| 3,246,424 | A * | 4/1966 | Gregory | A63H 27/14 | 446/40 |
| 3,570,467 | A * | 3/1971 | Belokin, Jr. | F41J 9/18 | 124/26 |
| 3,605,328 | A * | 9/1971 | Kilroy, Jr. | A63H 27/14 | 124/16 |
| 3,701,216 | A * | 10/1972 | Smith, III | A63F 7/2472 | 185/39 |
| 3,704,540 | A * | 12/1972 | Montagu | A63H 27/12 | 446/40 |
| 4,030,238 | A * | 6/1977 | Lakin | A63H 13/04 | 446/36 |
| 4,204,359 | A * | 5/1980 | Plo | A63H 27/12 | 446/41 |
| 4,781,642 | A * | 11/1988 | Stanzel | A63H 27/12 | 446/38 |
| 4,823,532 | A * | 4/1989 | Westerburgen | A63H 33/08 | 446/122 |
| 4,959,035 | A * | 9/1990 | Murasaki | A63H 17/00 | 446/263 |
| 5,474,482 | A * | 12/1995 | Davidson | A63H 27/12 | 446/219 |
| 5,525,086 | A * | 6/1996 | Gentile | A63H 27/10 | 446/234 |
| 6,221,409 | B1 * | 4/2001 | Bueno Ceresuela | A23G 3/50 | 426/104 |
| 7,481,691 | B2 * | 1/2009 | Sze | A63H 27/12 | 124/26 |
| 7,727,047 | B2 * | 6/2010 | Lopez | A63H 27/14 | 446/41 |
| 7,950,976 | B2 * | 5/2011 | Bernstein | A63H 17/008 | 446/39 |
| 8,715,032 | B2 * | 5/2014 | Horikoshi | A63H 1/12 | 446/256 |
| 9,821,245 | B2 * | 11/2017 | Larsen | A63H 33/088 | |
| 2002/0098768 | A1 * | 7/2002 | Kuo | A63H 27/12 | 446/39 |
| 2004/0161999 | A1 * | 8/2004 | Yu | A63H 27/12 | 446/36 |
| 2006/0046610 | A1 * | 3/2006 | Laurienzo | A63H 17/008 | 446/435 |
| 2006/0148373 | A1 * | 7/2006 | Vetuskey | A63H 17/008 | 446/73 |
| 2006/0183399 | A1 * | 8/2006 | Sze | A63H 27/12 | 446/45 |
| 2007/0117492 | A1 * | 5/2007 | Sze | A63H 27/12 | 446/57 |
| 2010/0248580 | A1 * | 9/2010 | Lin | A63H 27/005 | 446/56 |
| 2014/0239591 | A1 * | 8/2014 | Rehkemper | A63H 27/14 | 273/317 |

FOREIGN PATENT DOCUMENTS

| | | | |
|---|---|---|---|
| EP | 0 985 351 | A2 | 3/2000 |
| JP | H10-108985 | A | 4/1998 |
| JP | 2003 190647 | A | 7/2003 |
| JP | 2004 065593 | A | 3/2004 |
| WO | 2013156037 | A1 | 10/2013 |

OTHER PUBLICATIONS

DKPTO's First Office Action issued in priority application No. PA 2015 70031, dated Aug. 18, 2015. (English translation unavailable).
International Search Report issued in corresponding international application No. PCT/DK2016/050013, dated May 24, 2016.
Written Opinion of International Searching Authority issued in corresponding international application No. PCT/DK2016/050013, dated May 24, 2016.
DKPTO's First Office Action issued in related application No. PA 2015 70032, dated Aug. 17, 2015. (English translation unavailable).
International Search Report issued in related international application No. PCT/DK2016/050014, dated May 24, 2016.
Written Opinion of International Searching Authority issued in related international application No. PCT/DK2016/050014, dated May 24, 2016.
International Preliminary Report on Patentability issued in related international application No. PCT/DK2016/050014, dated Jan. 2, 2017.

* cited by examiner

TOY COMPRISING A ROTOR, AN ACTIVATION MECHANISM AND A LAUNCHING DEVICE

CROSS-REFERENCE TO RELATED APPLICATIONS

This application is a U.S. National Stage of International Application No. PCT/DK2016/050013, filed on 18 Jan. 2016 and published on 28 Jul. 2016, as WO 2016/116108 A1, which claims the benefit of priority to Danish Patent Application No. PA 2015 70031, filed on 21 Jan. 2015. The content of each of the above referenced patent applications is incorporated herein by reference in its entirety for any purpose whatsoever.

The present invention relates to a toy comprising a rotor, an actuator mechanism, and a launch device, wherein the rotor comprises an actuator mechanism, and wherein the toy comprises a launch device in the form of a cavity, wherein the cavity is configured for receiving the actuator mechanism, and wherein the actuator means can be inserted into a through-going slit opening to cooperate with the actuator mechanism to the effect that a momentum can be transferred from the actuator means to the rotor, whereby the rotor can be rotated and launched from the launch device.

BACKGROUND

Many variations of toys with flywheels and launch device are already available.

Those types of toy typically comprise a flywheel and a launch pad, wherein the launch pad has rotation-actuating means in the form of eg a cord pull, a toothed draw bar, or an electric motor. When the flywheel is located in the launch pad, the tractive force from the cord pull or the toothed bar is transferred to a rotation force which makes the flywheel rotate, and when the rotation force becomes sufficiently strong, the flywheel takes off from the launch pad.

U.S. Pat. No. 4,781,642 describes a toy comprising a launcher and a rotating blade. The rotating blade has a plurality of radially extending, generally horizontal blades that are adapted to rotate by means of an electric motor that is mounted within a handheld launcher. The blade has a central cockpit in which a figure device is located.

However, in many cases it is desirable to increase the options for variation.

BRIEF DESCRIPTION OF THE INVENTION

It is the object of the invention to provide a toy comprising a rotor, an actuator mechanism, and a launch device that create increased options for variation and are safer in use.

This is accomplished in that the toy comprises at least two toy building elements, of which the one toy building element comprises the launch device, and wherein the toy building element is provided with one or more of first types of coupling means, and the second toy building element is provided with one or more of second types of coupling means that are geometrically configured complementarily relative to the first type of coupling means, whereby the first and second types of coupling means can be interconnected to form a spatial structure comprising the launch device.

Hereby it is accomplished that an individual grip for the toy building element can be built, wherein the toy building elements are detachably interconnected. Moreover, the user can subsequently deconstruct and reuse the toy building elements to build new, spatial structures.

The term "rotor" is to be understood as a device which is configured such that the rotor creates, by rotation, a lift, thereby enabling it to lift itself off the launch device; it may eg be a rotor blade with inclining rotor blades.

According to an embodiment of the invention, one or more toy building elements comprise(s) at least two different types of coupling means, such as coupling studs and complementary coupling means. Hereby the variation options for play are increased.

According to one embodiment, the launch device is positioned at the one extremity of the first toy building element.

Hereby space is accomplished around the launch device, and thereby the risk is minimized that the user's fingers are caught by the rotor.

According to an embodiment, the launch device is configured as a cylindrically shaped cavity, and wherein the cylindrically shaped cavity is positioned coaxially with the axis of rotation of the rotor.

According to an embodiment, the one or more coupling means is/are positioned at the second extremity of the first toy building element.

Thereby it is accomplished that a spatial structure can be built around the first toy building element with small risk of being caught by the rotor blades.

According to an embodiment, the first and second types of the coupling means are positioned in lattice points in a first rectangular lattice plan.

By a construction of such spatial structure, the coupling means will form a pattern. The regular lattice may be a two-dimensional lattice or a three-dimensional lattice, wherein their mutual positions and distances between the coupling means follow a geometrical pattern; and wherein the lattice may be a quadrangular, cubic lattice or rectangular lattice.

According to an embodiment, the expanse of the through-going slit opening is perpendicular to the expanse of the first and second types of coupling means whereby the direction of the tractive force from the actuator means will take place at right angles to the coupling direction of the coupling means.

According to an embodiment, a first toy building element comprises at least three different types of coupling means, such as coupling studs, complementary coupling means and through-going cylindrical holes.

Hereby a wider range of variation options is accomplished for forming spatial structures that are capable of resisting the tractive force exerted by the actuator means when it actuates the rotor.

According to one embodiment, the third type of coupling means on the first toy building element is positioned in a second, regular lattice plan which is perpendicular to the first lattice plan, and wherein the third type of coupling means is arranged such that the centre axis of the third type of coupling means extends through the axis of rotation of the rotor, whereby twisting action in the structure is minimized when the rotor is actuated.

According to an embodiment, the first toy building element comprises a total of eight of the first type of coupling means, preferably in a lattice pattern of 2 by four coupling means.

Hereby the first toy building element has a size and an expanse and an interconnection force when it is interconnected to a structure of several toy building elements that may reduce the risk of separation due to tractive forces and twisting actions in the structure of several toy building elements upon actuation of the rotor. Owing to the expanse of the first toy building element, it will also be possible to use the first toy building element as a handle when the rotor is launched.

LIST OF FIGURES

An embodiment of the invention will now be explained in further detail with reference to the drawing, wherein FIG. 1 illustrates a toy according to the invention, in a perspective view;

DETAILED DESCRIPTION WITH REFERENCE TO THE FIGURES

Figure 1:
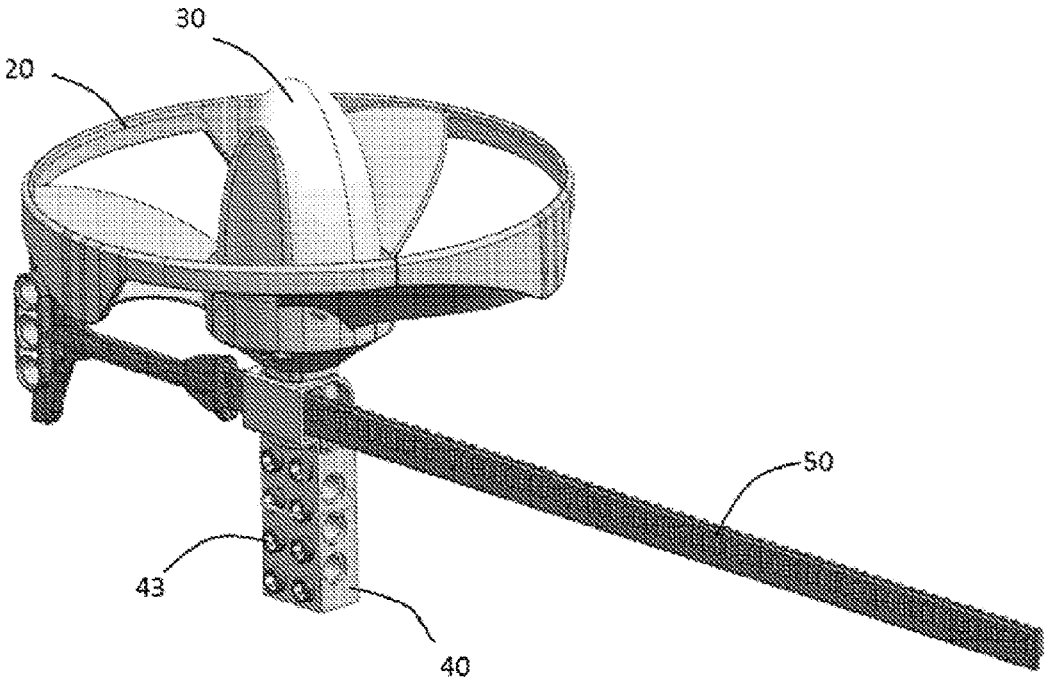

The present invention relates to a toy comprising a rotor (20) as illustrated in FIG. 1.

The toy comprises a first toy building element (40) that comprises a launch device. The rotor (20) comprising a capsule (30) can be arranged on the first toy building element (40) and may subsequently be caused to rotate via an actuator means (50) that transmits a momentum to the rotor that makes the rotor rotate and fly off the launch device.

In the embodiment shown, the rotor has the shape of a rotor blade with inclining rotor blades whereby the rotor can, by rotation, take off from the launch device.

Figure 2:
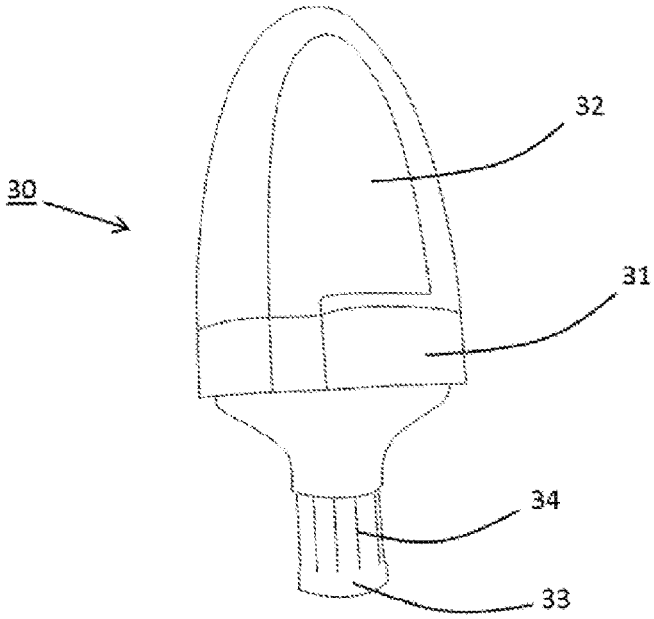
FIG. 2 illustrates a capsule with actuator mechanism.

FIG. 2 shows the centrally positioned capsule (30) comprising a first capsule part (31) and a second capsule part (32).

The first capsule part (31) comprises an actuator mechanism (33) that is illustrated as a toothed wheel (34).

In the shown embodiment, the capsule comprises means that are capable of engaging with a locking mechanism on the rotor part, whereby capsule and rotor can be locked to each other. This can be done in different ways and, in general, in some embodiments, the capsule and the rotor may be constituted by one unit which cannot be taken apart.

Figure 3:
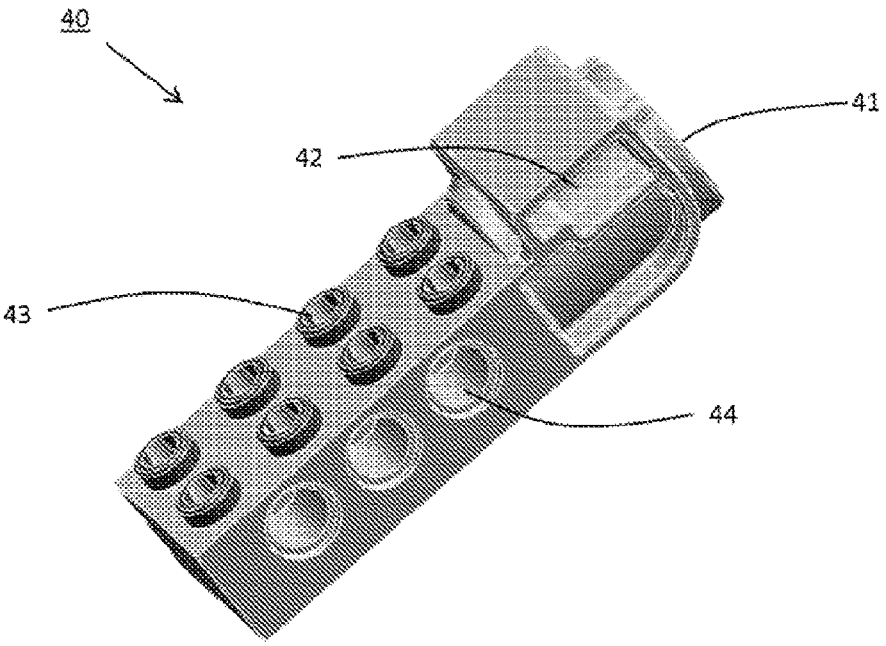
FIG. 3 illustrates, in a perspective view, a toy building element.

FIG. 3 shows the toy building element (40) with launch device (41) and a through-going slit (42). The launch device (41) is configured such that it is capable of completely or partially receiving the actuator mechanism (33).

The slit opening (42) is located such that it extends partially through the launch device (41), whereby, when the actuator means (50) is caused to extend through the slit opening (42), the actuator means (50) may be allowed to access and engage with the actuator mechanism (33) when it is positioned in the launch device (41).

The first toy building element comprises at least two different types of coupling means, such as coupling studs and complementary coupling means. In the illustrated example, the first toy building element comprises a third type of coupling means (44) in the form of through-going cylindrical holes that have a circular cross-section. This type of coupling means may receive a complementarily configured pin.

The expanse of the through-going slit opening (42) is perpendicular to the expanse of the first and second types of coupling means whereby the direction of the tractive force from the actuator means (50) will take place at right angles to the coupling direction of the coupling means.

The launch device (41) is configured such that it is capable of completely or partially receiving the actuator mechanism (33), whereby the actuator means (50) can be caused to extend through the through-going slit (42) and thereby transfer a momentum from the actuator means (50) to the actuator mechanism (33) thereby enabling the rotor (20) to be launched from the launch device (41).

The launch device (41) is positioned at the one extremity of the first toy building element and is configured as a cylindrically shaped cavity, and wherein the cylindrically shaped cavity is positioned coaxially to the axis of rotation of the rotor. The one or more coupling means is/are positioned at the second extremity of the first toy building element.

The first toy building element is illustrated with two different types of coupling means, viz coupling studs (43) and through-going cylindrical holes (44).

Figure 4:
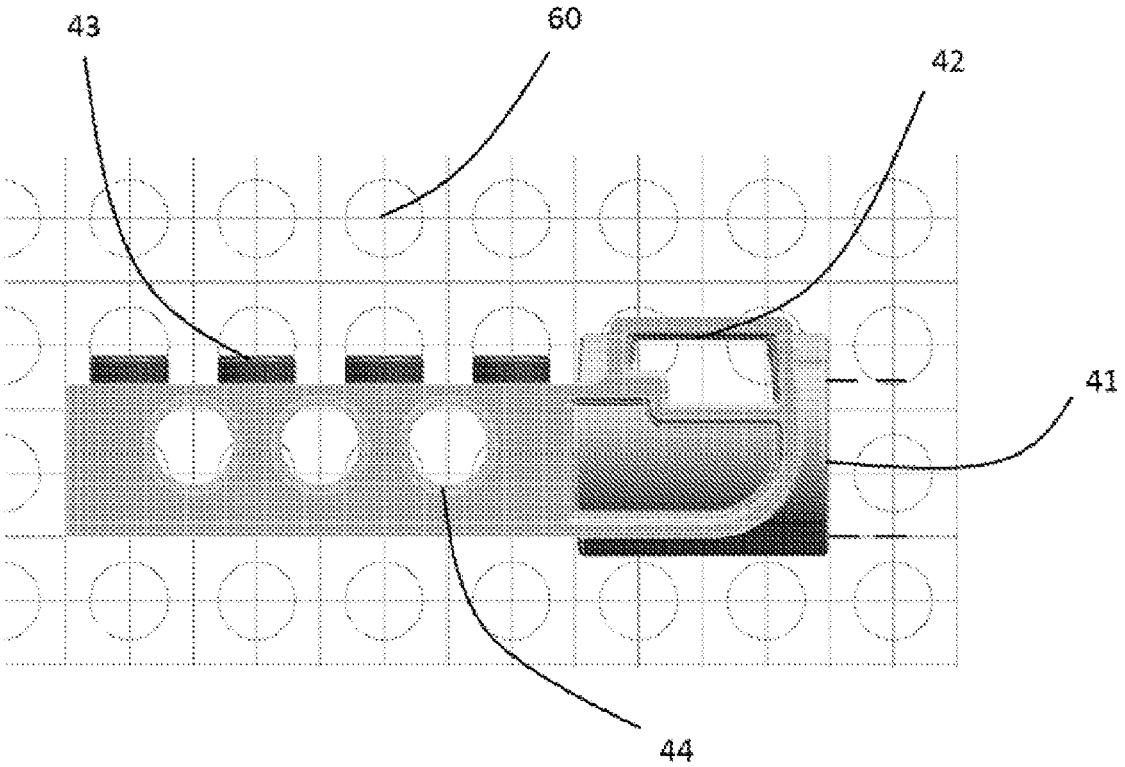
FIG. 4 illustrates the toy building element, seen from the side.

FIG. 4 shows the toy building element (40) seen from the side. The toy building element (40) has a launch device (41) and a through-going slit (42).

The slit opening (42) is located such that it extends partially through the launch device (41), whereby the actuator means is enabled to engage with the actuator mechanism (33) and thereby transmit a tractive force from the actuator means (50) to a rotation force via the actuator mechanism (33) to the rotor (20) thereby enabling the rotor (20) to be launched from the launch device (41).

Both the first type of coupling means 43 and the second type of coupling means 45 that are configured complementarily to the first type of coupling means are positioned in lattice points in a first regular lattice plan. The third type of coupling means 44 is positioned in lattice points in a second lattice plan at right angles to the first lattice plan.

The third type of coupling means is located such that the centre axis of the third type of coupling means extends through the axis of rotation of the rotor.

Figure 5:
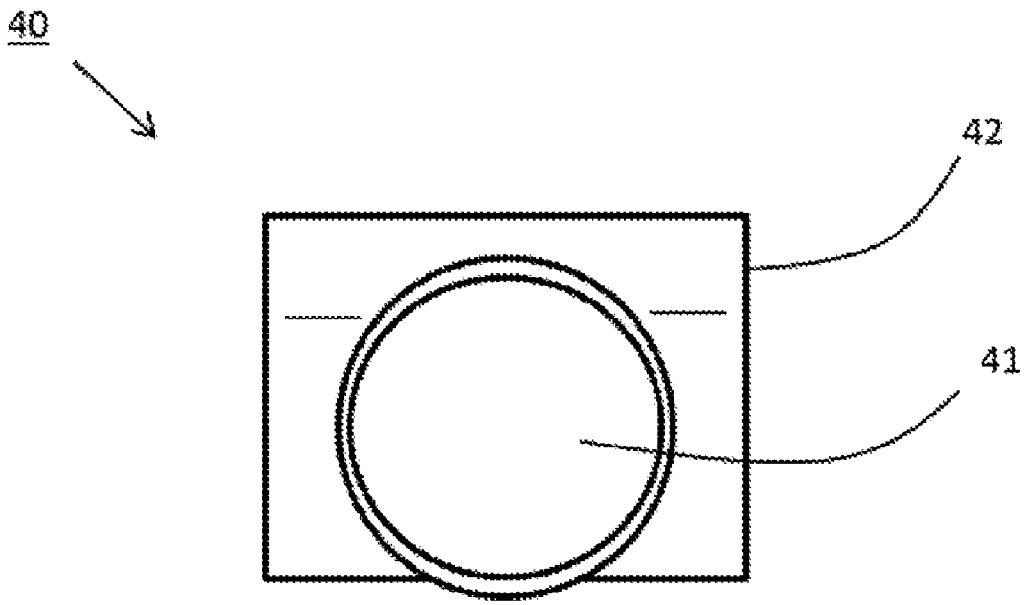
FIG. 5 illustrates the toy building element, seen from above.
Figure 6:
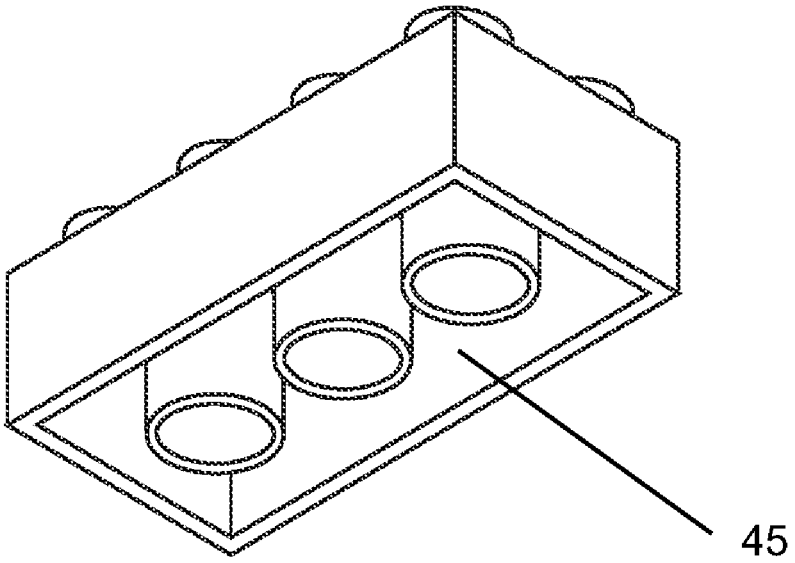
FIG. 6 illustrates a second toy building element, in a perspective view.

FIG. 5 shows the toy building element (40) seen from above. The launch device (41), which is likewise seen from above, is configured as a cylindrical cavity illustrated with a circular cross-section. The through-going slit (42) is illustrated with two dotted lines, which clarifies that an actuator means (50) that is inserted into the through-going slit (42) is capable of engaging with an actuator mechanism that is located in the launch device.

The invention claimed is:

1. A toy comprising:

a rotor comprising an actuator mechanism;

an actuator means; and a launch device comprising a cavity configured for receiving the actuator mechanism;

wherein the actuator means can be inserted into a through-going slit opening of the launch device to cooperate with the actuator mechanism so that momentum can be transferred from the actuator means to the actuator mechanism of the rotor, whereby the rotor can be rotated and launched from the launch device;

wherein the toy comprises at least two toy building elements, a first toy building element comprising the launch device and provided with one or more of a first type of coupling means positioned on an external surface thereof, and a second toy building element comprising one or more of a second type of coupling means positioned on an external surface thereof that is geometrically configured complementarily relative to the first type of coupling means, whereby the first and second types of coupling means can be releasably interconnected to form a spatial structure comprising the launch device.

2. A toy according to claim 1, wherein one or more of the toy building elements comprises at least two different types of coupling means.

3. A toy according to claim 2, wherein the at least two different types of coupling means comprise at least studs and complementary coupling means.

4. A toy according to claim 1, wherein the launch device is positioned at one extremity of the first toy building element.

5. A toy according to claim 1, wherein the launch device is configured as a cylindrically shaped cavity, and wherein the cylindrically shaped cavity is positioned coaxially with an axis of rotation of the rotor.

6. A toy according to claim 1, wherein the one or more type of coupling means is/are positioned at a second extremity of the first toy building element.

7. A toy according to claim 1, wherein the first and second types of the coupling means are positioned in lattice points in a first regular lattice plan.

8. A toy according to claim 1, wherein an expanse of the through-going slit opening is perpendicular to an expanse of the first and second types of coupling means whereby a direction of a tractive force from the actuator means will take place at right angles to a coupling direction of the coupling means.

9. A toy according to claim 1, wherein a first toy building element comprises at least three different types of coupling means.

10. A toy according to claim 9, wherein the first and second types of the coupling means are positioned in lattice points in a first regular lattice plan, and wherein a third type of coupling means on the first toy building element is positioned in lattice of points in a second, regular lattice plan which is perpendicular to the first regular lattice plan, and wherein the third type of coupling means is arranged such that a center axis of the third type of coupling means extends through an axis of rotation of the rotor, whereby twisting action in a structure is minimized when the rotor is actuated.

11. A toy according to claim 9, wherein the at least three different types of coupling means comprise at least coupling studs, complementary coupling means, and through-going cylindrical holes.

12. A toy according to claim 1, wherein the first toy building element comprises a total of eight of the first type of coupling means.

13. A toy according to claim 12, wherein the eight of the first type of coupling means are arranged in a lattice pattern of two by four coupling means.

* * * * *